United States Patent [19]

Nomura et al.

[11] 4,020,199

[45] Apr. 26, 1977

[54] PROCESS FOR PRODUCING ACRYLIC FIBERS HAVING ANIMAL HAIR-LIKE HAND

[75] Inventors: Katsuaki Nomura; Masaaki Fujimatsu, both of Okayama, Japan

[73] Assignee: Japan Exlan Company Limited, Japan

[22] Filed: Sept. 24, 1975

[21] Appl. No.: 616,311

Related U.S. Application Data

[63] Continuation of Ser. No. 415,400, Nov. 13, 1973, abandoned.

[30] Foreign Application Priority Data

Nov. 14, 1972 Japan ..... 47-114132

[52] U.S. Cl. ..... 427/334; 8/130.1; 8/115.6; 427/385 B; 427/387; 427/402; 428/391; 428/392; 428/394

[51] Int. Cl.[2] ..... B32B 27/30; C08J 7/04

[58] Field of Search ..... 8/130.1, 115.6, 175; 252/8.8; 427/385, 334, 387, 402; 428/522, 391, 392, 394

[56] References Cited

UNITED STATES PATENTS

| | | | |
|---|---|---|---|
| 3,281,260 | 10/1966 | Ucci | 117/33.3 |
| 3,366,584 | 1/1968 | Zimmerman | 260/4 |
| 3,455,771 | 7/1969 | Ichimi et al. | 427/385 |
| 3,488,217 | 1/1970 | Ryan | 117/138.8 |
| 3,619,278 | 5/1969 | Ogawa | 117/139.5 |
| 3,655,420 | 4/1972 | Tichenor | 260/824 X |
| 3,855,776 | 12/1974 | Omura et al. | 57/153 |

*Primary Examiner*—P.E. Willis, Jr.
*Attorney, Agent, or Firm*—Wenderoth, Lind & Ponack

[57] ABSTRACT

Process for imparting an animal hairlike hand to acrylic fibers by mixing a silicone resin and a polyoxyethylene alkylphenyl phosphate while adding water thereto to form an emulsion of weak acidity, applying the emulsion to swollen gelly acrylic fibers, drying the resultant fibers and applying a spinning oil to the dried fibers.

1 Claim, 2 Drawing Figures

PROCESS FOR PRODUCING ACRYLIC FIBERS HAVING ANIMAL HAIR-LIKE HAND

Figure 1:
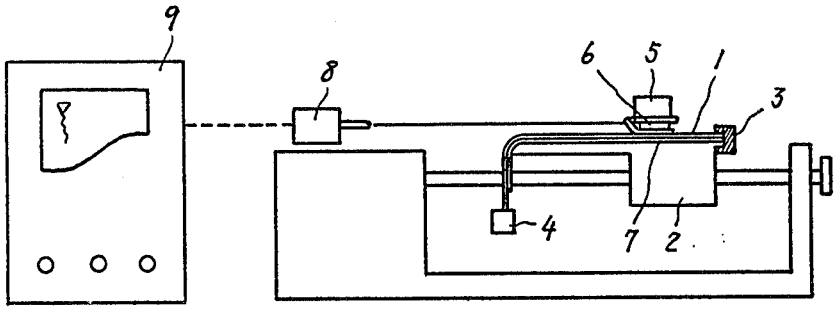

This is a continuation of application Ser. No. 415,400, filed Nov. 13, 1973 now abandoned.

This invention relates to processes for producing novel acrylic fibers having an animal hairlike hand and more particularly to a process for producing novel acrylic fibers characterized by forming an emulsion of weak acidity by adding water while mixing and agitating a silicone resin represented by a specific structural formula and an emulsifier selected from a group of POE (n') alkylphenyl phosphates and then depositing said emulsion on swollen gelly acrylic fibers.

It is well known that a knit or woven fabric made of such animal hair fibers as wool, cashmere or Angora rabbit hairs has an excellent hand based on a peculiar slippery touch. However, there are recognized defects in a knit or woven fabric made of such animal hair fibers. For example, there has been recognized a defect that, due to a scaly structure on the fiber surface, by such treatment accompanied with a tumbling action as washing, a peculiar movement having a directivity is caused between the fibers forming the knit or woven fabric to shrink the fabric.

In fact, there has been already attempted a method wherein a chemical solution is made to act on animal hair fibers or a knit or woven fabric made of said fibers so that the scaly structure of the fiber surface may be destroyed and an antishrinkability may be imparted to eliminate such defect. It is true that the antishrinkability of a knit or woven fabric made of animal hair fibers is improved by such chemical solution treatment. However, by such method, there have been caused such disadvantages that the hand or particularly the slippery touch of the final product is remarkably reduced.

On the other hand, in order to eliminate such defects of the conventional technique and to improve the stability of the dimensions at the time of washing, there is generally used a method wherein a knit or woven fabric is formed by mix-spinning synthetic fibers having no scaly structure on the surfaces, such as acrylic fibers, with animal hair fibers. However, although in such mix-spun knit or woven fabric, some improved effect is seen in the stability of the dimensions in the tumbling action, the level of the slippery touch contributing directly to the maintenance of the animal hairlike hand is inherently low, resulting in a sensory evaluation of said slippery touch which is quite different from that of a knit or woven fabric made of animal hair fibers.

There is also suggested a method wherein, aside from an attempt to use the above mentioned animal hair fibers as materials for forming knit or woven fabrics, in order to give a slippery touch to synthetic fibers or yarns or knit or woven fabrics obtained from said fibers, a polyhydric alcohol type nonionic surface active agent or a specific cationic surface active agent or anionic surface active agent is deposited on the surfaces of synthetic fibers. It is true that, by the treatment with each surface active agent, some slippery touch is imparted to the synthetic fibers, but there are defects in that the slippery touch resulting from such surface active agent is recognized to have no durability to washing and quickly reduces the commodity value of said fiber products. It has been strongly desired in the industry to find a way to solve such defects.

Further, it is mentioned in Japanese Patent Publication No. 27520/1969 and No. 28733/1970 to use a higher ester of acrylic acid or methacrylic acid or a vinyl ester of a higher fatty acid as a fiber treating agent. However, the slippery touch given by such fiber treating agent is quite different from the slippery touch seen in animal hair fiber products and it is generally difficult to expect the effect of improving the hand of the final product with such fiber treating agent.

Further, it is mentioned in British Pat. No. 1,111,880 and Japanese Patent Publication No. 26436/1969 to improve the hand of acrylic fiber products by depositing a silicone resin on the acrylic fibers. However, in the former, no definite knowledge on the silicone resin to be used as a fiber treating agent is disclosed and the hand of the acrylic fiber product improved by such silicone resin process is quite different from the slippery touch and is only an improvement in the softness or antipilling property. In the latter, as a mixed treating agent of a silicone resin and an epoxy resin is used as a treating agent for acrylic fiber products, the hand of the final product will become rough and hard due to the bonding and hardening of the fibers and, as the slippery touch imparted by the silicone resin is barred by the epoxy resin, the commodity value of the final product will be greatly reduced.

The present inventors have carried out research to find an industrial process of imparting a slippery touch very similar to that of an animal hair fiber product, a softness and an antishrinkability to acrylic fibers or their products by totally eliminating such defects of the conventional technique, and have reached the present invention by discovering the fact that acrylic fibers having a permanent slippery touch can be produced by forming an emulsion of weak acidity by adding water while mixing and agitating a silicone resin represented by a specific structural formula and an emulsifier selected from a group of POE (n') alkylphenyl phoshates, depositing said emulsion on swollen gelly acrylic fibers obtained by wet-spinning, then immediately drying it and then imparting a spinning oil agent to the obtained acrylic fibers.

A main object of the present invention is to provide a process for producing novel acrylic fibers having an animal hairlike hand.

Another main object of the present invention is to provide an industrial process of imparting an animal hairlike slippery touch and a durability of the slippery touch to the washing treatment to acrylic fibers or their products.

Another object of the present invention is to provide novel technical knowledge on the structural characteristic of a silicone resin adapted to impart an animal hairlike hand to acrylic fibers, and a process for the preparation of an emulsion of said silicone resin.

Other objects of the present invention will become clear from the description of the following specification.

These objects of the present invention can be effectively attained by providing a process for producing novel acrylic fibers by forming an emulsion of weak acidity by adding water while mixing and agitating a silicone resin represented by the general formula (1)

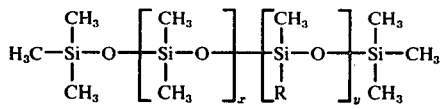

(1)

(wherein R is $R'NH_2$, $R'NHR''$ or $R'NR''_2$, R' is $-(CH_2)_n-$, $n$ is 1 to 3, R'' is $C_mH_{2m+1}$, $m$ is 1 to 3 and $x$ and $y$ are positive integers when the molecular weight of the silicone resin is less than 100,000) and an emulsifier selected from a group of POE (n') alkylphenyl phosphates (wherein n' is a polymerization degree of the polyoxyethylene), depositing said emulsion on swollen gelly acrylic fibers obtained by wet-spinning, then immediately drying it so that said silicone resin may be fixed on the fiber surfaces and then imparting a spinning oil agent to the obtained acrylic fibers.

Figure 2:
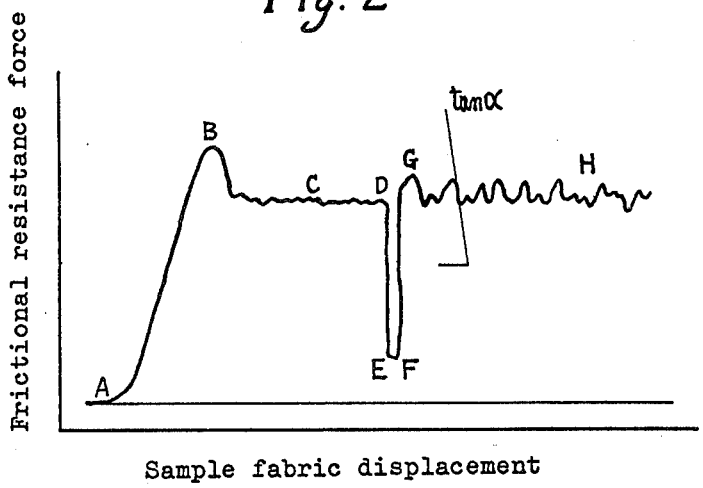

The invention will be further explained below in detail by partly referring to the accompanying drawings wherein:

FIG. 1 is an explanatory view of a fabric friction measuring apparatus to be used to measure a slippery touch; and FIG. 2 is an orthogonal coordinate diagram exemplifying the relation between the frictional resistance force recorded by said measuring apparatus and the sample fabric displacement.

The swollen gelly acrylic fibers in the present invention are generally fibers which consist of an acrylonitrile homopolymer or of a copolymer containing more than 70% by weight acrylonitrile and other vinylic monomers and in which the water content before drying after wet-spinning is 40 to 100% based on the dry fiber weight. Further, as POE (n') alkylphenyl phosphates used to form the emulsion of weak acidity, there can be enumerated such phosphates as POE (8) octylphenyl phoshate, POE (9) octylphenyl phosphate, POE (8) nonylphenyl phosphate, POE (9) nonylphenyl phosphate and POE (10) dodecylphenyl phosphate which have an n' value of from 5 to 15 (wherein n' is the polymerization degree of the polyoxyethylene) and 8 to 12 carbon atoms in the alkyl group.

As the silicone resin represented by the general formula (1) acts as a base in the case of the emulsification, in order to maintain weak acidity of the finally obtained emulsion, it is necessary to select an acid emulsifier. The above described POE (n') alkylphenyl phosphates (wherein the polymerization degree n' of the polyoxyethylene is 5 to 15 and the number of carbon atoms in the alkyl group is 8 to 12) will give a pH value of 5.5 to 6.8 necessary to improve the stability of the emulsion in the case of preparing an emulsion by mixing and agitating such phosphates with a silicone resin represented by the general formula (1) and adding water, or by a so-called reverse dissolving method. It is desirable to mix more than 50 parts by weight of the above mentioned POE (n') alkylphenyl phosphate with 100 parts by weight of the silicone resin represented by the general formula (1) so long as such pH value is satisfied.

Further, it is desirable to maintain the temperature at the time of emulsification at 35° to 60° C., or more preferably at 40° to 58° C.

As evident from the above mentioned explanation, the present invention deposits an emulsion prepared by mixing a specific silicone resin and an emulsifier on swollen gelly acrylic fibers not yet dried after being wet-spun. The reactive $NH_2$ group contained in the silicone resin forms a strong ion bond with the dyeing site present in the swollen gelly acyrlic fiber so that the durability of the animal hairlike slippery touch imparted to said acrylic fibers may be remarkably improved without reducing the dyeability of the entire fibers at all.

In working the present invention, in order to given an animal hairlike slippery touch to the treated fibers and to make it easy to deposit a spinning oil agent in the subsequent step, it is recommended that the weight of the silicone resin to be deposited on the swollen gelly acrylic fibers sould be 0.1 to 3%, or more preferably 0.5 to 2.0% on the weight of the dry acrylic fibers.

That is to say, in case the amount of deposition of the above mentioned silicone resin is less than 0.1% on the dry weight of the fibers, the slippery touch of the treated fibers will not be substantially improved and no animal hairlike hand will be imparted to the final product. Further, in case the amount of deposition of the silicone resin defined by the general formula (1) exceeds 3% on the dry weight of the fibers, the fibers will stick to each other and will be rolled up on the taker-in roller of the carding machine in the spinning step, which of course is not desirable.

The acrylic fibers on which the emulsion containing the specific silicone resin defined by the general formula (1) is deposited are then dried at a temperature of 60° to 140° C., or more preferably 80° to 120° C., so that the silicone resin may be oriented and fixed on the fibers and then can be fed to the heat-relaxing and mechanical crimping steps. If the swollen gelly acrylic fibers on which said silicone resin is deposited are fed to the steps of the heat-relaxing treatment with saturated steam and the mechanical crimping treatment without being dried, the silicone resin will drop and the desired animal hairlike slippery touch will not be imparted to the fibers.

After the drying, a spinning oil agent is further applied to the acrylic fibers on which the silicone resin defined by the general formula (1) is deposited. That is to say, as the spinnability of the acrylic fibers on which the silicone resin is deposited reduces due to the reduction of the frictional resistance, in order to simultaneously satisfy the animal hairlike hand and spinnability, it is necessary to apply a spinning oil agent to the acrylic fibers on which the silicone resin is deposited and then dried in a bath different from that of the emulsion of said silicone resin. Therefore, in working the method of the present invention, so long as the treated fibers on which the silicone is deposited are immediately dried and then the spinning oil agent is applied to them, the above described heat-relaxing or mechanical crimping step can be combined with any of such fiber drying and spinning oil agent application steps.

The present inventors have disclosed the fact that the hand of acrylic fibers can be remarkably improved as described above by the treatment with an emulsion of weak acidity in which a specific silicone resin is dispersed and an animal hairlike slippery touch can be imparted to the treated fibers, and have further discovered the fact that, as a means of quantitatively determining the effect of the present invention, the stress reduction rate tan $\alpha$ at the time of the kinetic friction of the knit or woven fabric made of the treated fibers shows a favorable correspondence to the slippery touch.

That is to say, the present inventors have confirmed the fact that the slippery touch of the acrylic fibers made by the process of the present invention can be quantitatively determined by the frictional characteristic between knit or woven fabrics made of said acrylic fibers or particularly the stress reduction rate tan $\alpha$ at the time of the kinetic friction as measured with the cloth friction measuring apparatus exemplified in FIG. 1, and have discovered that, though somewhat different depending on the construction or structure of the knit or woven fabric, when the value of said tan $\alpha$ is in a range of 5 to 25 g./mm., a slippery touch very similar to that of a knit or woven fabric made of animal hair fibers will be imparted to the sample acrylic fibers According to the results of experiments made by the present inventors the frictional characteristic of a knit or woven fabric of acrylic fibers made in an ordinary manner and having no slippery touch shows a clear stick-slip wave form and it is impossible to indicate its hand characteristic by the stress reduction rate tan $\alpha$ at the time of the kinetic friction.

Prior to the description of an example, the method of measuring the stress reduction rate tan $\alpha$ at the time of the kinetic friction shall be explained in the following.

The stress reduction rate tan $\alpha$ at the time of the kinetic friction is determined by magnifying and measuring the kinetic frictional force between sample fabrics by using the fabric friction measuring apparatus shown in FIG. 1. It shall be explained more particularly by also using FIG. 2. A sample fabric 1 is mounted on a sample table 2 in a humidity-adjusted atmosphere at 20° C. under a relative humidity of 65%, is fixed at one end with a sample presser 3, has a load 4 of 30 g. act on the other end and is thus kept tensioned. A slider 6 of an effective contact area of 3 cm.$^2$(2 cm. × 1.5 cm.) on which a compression load 5 of 450 g. is made to act is mounted on the sample fabric 1. A sample fabric piece 7 is fixed to the lower surface of the slider 6. The sample table 2 is thus moved at a constant velocity of 12 mm./min. and the frictional force produced between the sample fabrics is detected with a resistance wire strain meter 8 connected with the slider 6 and is recorded with a recorder 9. In the case of the measurement, when the kinetic frictional force shows a constant state, the indicator of the recorder is shifted to zero point and then, as shown at the points F and G, the detection sensitivity is magnified to be 5 to 10 times as high to magnify and measure the slight variation of the kinetic frictional force. the stress reduction rate tan $\alpha$ at the time of the kinetic friction means the gradient of the stress reducing part in which a slip occurs between the sample fabrics in the magnified measurement graph and can be indicated as a stress reduction rate per mm. of the displacement of the sample fabric. Therefore, it is meant that, the smaller the tan $\alpha$ , the larger the slippery touch.

The acrylic fibers produced by the process of the present invention have an excellent spinnability and a peculiar animal hairlike or particularly wooly slippery touch, do not have the silicone resin dropped by such after-processes as the refinement and dyeing and are very high in durability to washing.

In this sense, it may be said that the process of the present invention provides a noteworthy knowledge of a means of improving the hand of acrylic fibers or their products.

An example of the present invention is mentioned in the following. However the scope of the present invention is not limited by this example.

In the example, the parts and percentages are all by weight unless otherwise specified.

EXAMPLE 1

A spinning solution obtained by dissolving in an aqueous solution of sodium thiocyanate a copolymer obtained by copolymerizing 9.8% methyl acrylate and 0.2% sodium methallysulfonate with 90% acrylonitrile was wet-spun into cold water and was then water-washed and stretched in an ordinary manner to prepare a swollen gelly acrylic fiber tow of a water content of 80%. This fiber tow was dipped for 3 seconds in an emulsion of a pH value of 6.8 prepared by emulsifying and mixing 2% silicone resin of the structural formula (1) wherein R was $CH_2NH_2$, 1% POE (9) nonylphenyl phosphate and 0.2% catalyst Sumitex SX-70A produced by Sumitomo Chemical Company, Limited, was then squeezed so that the amount of deposition of the emulsion might be 80% on the dry weight of the fibers and was then treated for 15 minutes in an atmosphere at a dry bulb temperature of 125° C. and a wet bulb temperature of 60° C. so that the fiber structure might collapse and, at the same time, the silicone resin might be oriented and fixed to the treated acrylic fibers.

The fiber tow was then further treated for 8 minutes in compressed steam at 130° C. so that the fiber structure might relax, was then fed into a stuffer box so as to be crimped, had 0.33% on the dry weight of the fibers Nissan Unilube 50MB-168 produced by Nippon Oils and Fats Co. as a spinning oil agent deposited on it, was dried and was then cut to be of unequal lengths of 60 to 140 mm. to make acrylic fibers of a monofilament fineness of 2.5 deniers (acrylic fibers 1). The rate of deposition of the silicone on these fibers was 0.95 %.

Then an acrylonitrile copolymer having the same composition as of the above mentioned acrylic fibers was wet-spun in an ordinary manner to make an acrylic fiber tow of a monofilament fineness of 3 deniers. Then said acrylic fiber tow was fed into a turbostapler, was secondarily stretched to 1.16 times its length at a hot plate temperature of 150° C., was then mechanically crimped and was cut to make highly shrinkable acrylic fiber staples having a latent hot water shrinkage of 12.8% (acrylic fibers 2).

Then 60% of the above mentioned nonshrinkable acrylic fibers (acrylic fibers 1) and 40% highly shrinkable acrylic fibers (acrylic fibers 2) were mix-spun in an ordinary manner to make a two folded yarn of a yarn count of 52 (metric yarn count).

The obtained mix-spun yarn was dipped in a dyeing solution of a cationic dye and was skein-dyed in an ordinary manner so that the latent shrinkability might be developed simultaneously with the dyeing and a bulkiness might be imparted to the yarn. Two of such mix-spun yarns were plyed and fed into a weft knitting machine of 14 G, were knitted to be of a plain fabric, were then stretched by 4% in the longitudinal direction and were set by Hoffman-set (knit fabric 1).

Then, as a control, a plain knit fabric (knit fabric 2) was made by spinning under the same conditions as in Example 1 except that nonshrinkable acrylic fibers having had only a cationic softening agent Zontes TA 460-15 produced by Matsumoto Oils and Fats Co. deposited on them without applying the emulsion bath treatment of the silicone resin recommended in the present invention were used instead of the above mentioned acrylic fibers 1.

Further, a decomposed knit fabric of a seater of a plain structure consisting of commercial wool fibers alone was prepared as another control sample (knit fabric 3).

The stress reduction rate tan $\alpha$ at the time of the kinetic friction of each of these knit fabrics is shown in Table 1. From these results, it will be understood that the knit fabric 1 satisfying all the conditions proposed in the present invention has a permanent slippery touch very similar to that of animal hair fibers. The tan $\alpha$ of the knit fabric after being washed was measured by using a sample whose washing shrinkage had been measured.

Table 1

| | Stress reduction rate tan $\alpha$ at the time of the kinetic friction | | |
|---|---|---|---|
| | Before being washed | After being washed | Washing shrinkage |
| Knit fabric 1 | 14.2 g./mm. | 14.8 g./mm. | 3.5% |
| Knit fabric 2 | 16.7 " | over 100 g./mm. | 3.0% |
| Knit fabric 3 | 13.2 " | Stick-slip — | 15.0% |

Further, aside from the above mentioned table 1, the slippery touch was sensorily evaluated. It was confirmed that the knit fabric 1 had a favorable slippery touch so similar to that of the knit fabric 3 as to be hardly distinguished from it. The knit fabric 1 was favorable also in such other sensorily evaluated elements as, for example, the bulkiness, stiffness and hardness and was recognized to have a remarkably improved commodity value.

Other sample acrylic fibers for which the concentration of the silicone resin in the emulsion had been increased, the squeezing rate after the dipping treatment in the emulsion had been reduced and the amount of deposition of the silicone had been adjusted to be 3.7 % became rolled up frequently due to the sticking in the carding step in the spinning process and no satisfactory yarn could be made of them.

As the washing shrinkage is used as a physical property value for evaluating the dimensional stability of the acrylic fiber knit fabric in the above mentioned example, its summary shall be explained together with the method of measuring the silicone resin deposition rate.

Washing shrinkage

Two sheets of sample cloth of a length of 50 cm. of one side are prepared, have a circle of a diameter of 20 cm. described in the center of each of them, are then put into a domestic washing machine (of a vortex type) together with 1 g./liter of Monogen Uni (detergent), are washed for 5 minutes while maintaining a liquor ratio of 50:1 and are then rinsed for 7 minutes. Then the sample cloths taken out are spread on a table without being dehydrated and are naturally dried. Then the diameters in the longitudinal direction and lateral direction of the circle described in each sample cloth are measured to determine the average values of the shrinkages in the longitudinal direction and lateral direction.

Silicone resin deposition rate

Several kinds of organic solvent phases in which the concentration of the same kind of silicone resin as the silicone resin to be deposited on the sample fibers is varied are first prepared and intensities of the infrared absorption at 800 cm.$^{-1}$ of these organic solvent phases are determined with an infrared spectro-photometer, Model 521 manufactured by Perkin Elmer Co., and then a calibration line showing a relation between the amount of the silicone resin and the intensity of the infrared absorption of the groups, Si—$CH_3$ and Si—$(CH_3)_2$, at 800 cm.$^{-1}$ is determined.

Then the acrylic fibers to be tested are cut to a length of 0.1 to 0.3 mm., 3 mg. of them are weighed and are mixed with separately weighed 200 mg. of potassium bromide and the mixture is mixed and ground in an ordinary manner and is then molded into tablets (sample A). Further, tablets of acrylic fibers having had no silicone resin deposited on them are made in the same manner (sample B). Then, the sample A is placed on the sample side and the sample B on the compensating side of the above mentioned infrared spectrophotometer and the intensity of the infrared absorption of 800 cm.$^{-1}$ is measured. The amount of deposition of the silicone resin on the sample A is obtained from the intensity thus measured and the calibration line determined previously.

What we claim is:

1. A process for preparing acrylic fibers having an animal hairlike hand which comprises preparing an emulsion of pH 5.5 to 6.8 consisting essentially of (1) a silicone resin of the formula

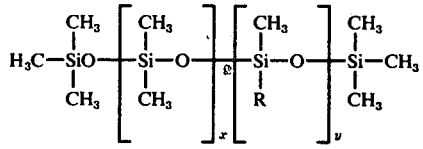

wherein R is $R'NH_2$, $R'NHR''$ or $R'NR''_2$, R' is $-(CH_2)_n-$, $n$ is 1 to 3, R'' is $C_mH_{2m+1}$, $m$ is 1 to 3, $x$ and $y$ are positive integers and the molecular weight of the silicone resin is less than 100,000 and (2) an emulsifier selected from the group consisting of polyoxyethylene (n') monoalkylphenyl phosphates, wherein n' is the number of ethylene oxide groups and is a value of 5 to 15, and the alkyl group contains 8 to 12 carbon atoms, and (3) water, depositing said emulsion on undried wet-spun swollen gelly acrylic fibers containing 40 to 100% by weight of water based on the dry weight of the fibers, in an amount of 0.1 to 3.0% by weight of the silicone resin based on the dry weight of the fibers, immediately drying the resultant fibers to fix said silicone resin on the fiber surfaces and applying a spinning oil agent to the dried fibers.

* * * * *